United States Patent [19]

Rohner et al.

[11] Patent Number: 4,610,132

[45] Date of Patent: Sep. 9, 1986

[54] COMPRESSED AIR THREAD SPLICING DEVICE

[75] Inventors: Joachim Rohner; Heinz Zumfeld; Reinhard Mauries, all of Monchen-Gladbach, Fed. Rep. of Germany

[73] Assignee: W. Schlafhorst & Co., Monchen-Gladbach, Fed. Rep. of Germany

[21] Appl. No.: 701,942

[22] Filed: Feb. 15, 1985

[30] Foreign Application Priority Data

Feb. 15, 1984 [DE] Fed. Rep. of Germany ..... 3405304

[51] Int. Cl.[4] ..... D01H 15/00

[52] U.S. Cl. ..... 57/22; 57/263

[58] Field of Search ..... 57/22, 23, 261, 263, 57/251, 908

[56] References Cited

U.S. PATENT DOCUMENTS 4,397,137 8/1983 Davies et al. ..... 57/22

4,497,165 2/1985 Vollm ..... 57/22

FOREIGN PATENT DOCUMENTS 2112036 7/1983 United Kingdom ..... 57/22

*Primary Examiner*—Donald Watkins

*Attorney, Agent, or Firm*—Herbert L. Lerner; Laurence A. Greenberg

[57] ABSTRACT

A compressed air thread splicing device for producing a knot-free thread connection by splicing includes a splicing head having a splicing channel formed therein with two at least partially open ends for receiving threads to be joined in a given insertion direction and for alternately tangling, intertwining, swirling and winding fibers of the threads around each other, the splicing head having at least one compressed air inlet orifice formed therein leading into the splicing channel, the splicing head having at least one flow-channel formed therein branching off from the splicing channel transverse to the given insertion direction between the at least one inlet orifice and one of the ends of the splicing channel, and a switchable device connected to the at least one flow channel for generating a temporally limited current in the at least one flow channel in a flow direction away from the splicing channel.

9 Claims, 6 Drawing Figures

COMPRESSED AIR THREAD SPLICING DEVICE

The invention relates to a compressed air thread splicing device for producing a knot-free thread connection by splicing, including a splicing head having at least one compressed air inlet opening and a splicing channel which is at least partially open at both ends, for receiving threads to be joined together and for alternately tangling, intertwining, swirling and/or winding the fibers of the threads around each other.

In thread splicing devices of this type, the quality of the spliced joint depends on the good preparation of the thread endings. The thread ends were heretofore prepared upstream or downstream of the splicing channel with respect to the direction of the thread motion, and the required preparation devices required working space at the place where the least space was available, i.e. in the winding direction, so that the preparation of the thread endings were difficult, and required additional space at the individual working stations of a winding frame. Furthermore, with the thread ends prepared in this way, a short splice connection of a specified short length cannot be produced.

It is accordingly an object of the invention to provide a compressed air thread splicing device which overcomes the hereinafore-mentioned disadvantages of the heretofore-known devices of this general type, to permit a shorter splice to be made, and to provide improved preparation of the thread ends, without requiring space in the direction of the thread motion.

With the foregoing and other objects in view, there is provided, in accordance with the invention, a compressed air thread splicing device for producing a knot-free thread connection by splicing, comprising a splicing head having a splicing channel formed therein with two at least partially open ends for receiving threads to be joined in a given insertion direction and for alternately tangling, intertwining, swirling and/or winding fibers of the threads around each other, the splicing head having at least one compressed air inlet orifice formed therein leading into the splicing channel, the splicing head having at least one flow-channel formed therein branching off from the splicing channel transverse to the given insertion direction between the at least one inlet orifice and one of the ends of the splicing channel, and switchable means connected to the at least one flow channel for generating a temporally limited current in the at least one flow channel in a flow direction away from the splicing channel.

In accordance with another feature of the invention, the at least one flow channel has a smaller flow cross section than the splicing channel.

Through the use of the invention, the preparation of the thread ends for splicing can be effected in the splicing head itself, without the necessity of increasing the length of the splicing channel in the direction of the motion of the thread for this purpose and without increasing the length of the splicing head itself for preparation of the thread-ends. It is also not necessary to allow additional space at the individual winding stations of a winding frame or spinning machine for preparing the thread endings. During the splicing operation, the prepared thread ends can be pneumatically held very close to the splicing point, so that very short splices with only a small part or no parts extending from the splicing point, can be created. For this reason, very good splice joints are able to be produced even with threads of a special fiber structure and fiber mixture, which up to now would not permit a satisfactory splicing connection to be made.

For example, the flow in the direction away from the splicing channel may be supplied separately in sequence for each flow channel, so that each of the two thread endings is gripped by the flow one after the other, is pulled into the flow channel, and can be prepared there by the air flow. In this way, the fiber unions are loosened, short fibers are blown away, and any twist in the thread is dissolved.

For generating the flow it is advantageous if the current generating means includes an injector leading into the at least one flow channel.

In accordance with a further feature of the invention, the injector includes an air injector channel discharging into the at least one air flow channel in the splicing head and slanting in the flow direction away from the splicing channel. It is advantageous if the flow is effected by several air surges, or by forced convection of the injection air.

The actual splicing takes place in a separate operational step after the preparation of the thread endings, during which the thread ends in the flow channels are held by the air flow, either only during the beginning of the splicing operation, or up to the end of the splicing operation, so that no undesired long thread ends later protrude from the finished splice. With threads having a certain structure and fiber mixture this is the only way a splice can be successfully produced.

In other cases, the air flow through the flow channels can be stopped before or shortly after the start of the actual splicing operation. Before the actual splicing operation, the prepared thread endings may be completely or partly retracted from the flow channels by mechanical means which are disposed outside the splicing head. However, the retracting of the thread endings from the flow channels is not necessary under certain circumstances, if the flow cross section of the flow channels is smaller than the flow cross section of the splicing channel.

In this case, the splicing or compressed air rushing into the splicing channel during the splicing operation pulls the thread endings out of the flow channels, because the splicing air rushing past the ends of the flow channels generates an air flow directed toward the splicing channel.

In accordance with an added feature of the invention, the at least one flow channel ends at the splicing channel closer to one of the ends of the splicing channel than the other, and the flow channel is slanted toward the one end of the splicing channel. This reversed flow during the splicing operation is even further increased in this way.

In accordance with still a further feature of the invention, the at least one flow channel discharges into the surroundings. In this way, the preparation of the thread ends is enhanced, especially since the flow channels are disposed transversely to the insertion direction of the threads. The air escaping from the flow channels as well as particles loosened from the thread ends, are thus discharged laterally and do not disturb the threads which are disposed in the splicing channel.

In accordance with still an additional feature of the invention, the at least one flow channel has an end leading into the splicing channel, and the splicing head has a flow obstruction in the splicing channel between the at least one inlet orifice and the end of the flow channel.

The object of such a flow obstruction is to improve the splicing operation and to prevent the entry of splicing air into the flow channels.

The preparation of the thread ends should be performed over as short a time as possible. When processing certain threads having a special structure and configuration, such as thickly twisted threads, difficulties are encountered. Either the preparation of the thread ends cannot be achieved by a pneumatic flow alone, or the preparation takes too much time.

In accordance with still an added feature of the invention, the at least one flow channel has a discharge end, and including a thread end preparation device disposed upstream of the discharge end, the preparation device including at least one contact surface movable toward a thread end projecting from the discharge end for contacting fibers of the thread, the contact surface being acted upon by escaping compressed air from the discharge end. This improves and accelerates the preparation of the thread endings even in the cases mentioned above.

In accordance with still a further feature of the invention, the thread end preparation device is in the form of a wheel having blades rotating adjacent a thread guiding surface. Such a wheel with blades can be set in motion by the air escaping from the flow channel. However, the wheel may also be driven by a motor. For example, the blades may have a brush-like configuration. The blades act on the fibers of the thread ending with friction and impact and form a new thread end due to the contact with the fibers at the point where they hit the thread, while excessive thread portions or fibers may be removed by mechanical or pneumatic means.

In accordance with a concomitant feature of the invention, the thread guiding surface opposite the wheel is curved. If the curvature is convex and directed against the bladed wheel, a line of intensive hitting and rubbing contact between the wheel and the blades can be produced. Brush-like blades can drag over the convex surface, and thereby act on the thread and the fibers.

On the other hand, for certain types of threads, a thread guide surface with its concave side against the blades of the wheel has advantages, because in this case a longer contact area is possible, and because the thread or thread end is necessarily deflected at the thread guiding surface, so that a very close contact with the fibers is again established.

Other features which are considered as characteristic for the invention are set forth in the appended claims.

Although the invention is illustrated and described herein as embodied in a compressed air thread splicing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
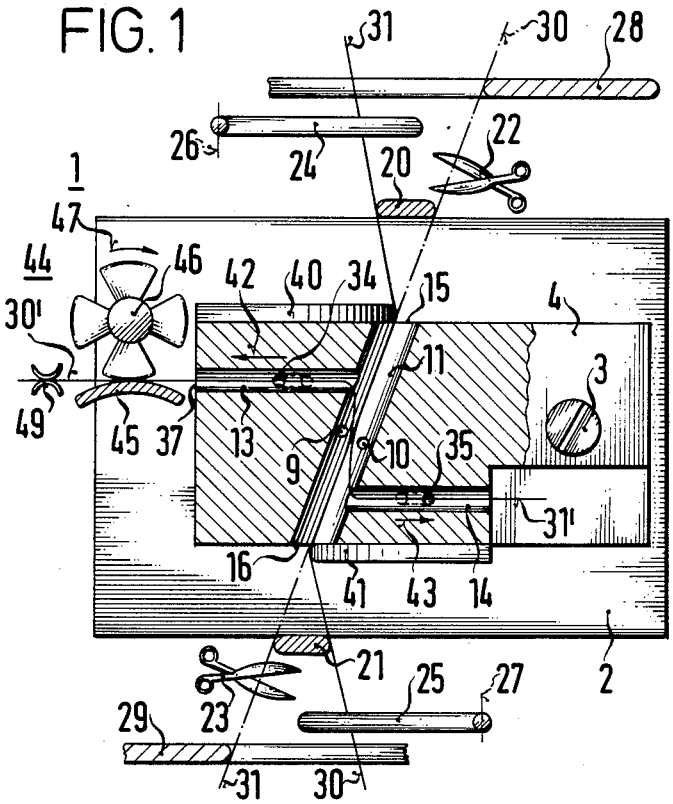
FIG. 1 is a fragmentary, diagrammatic, front-elevational view of the compressed air thread splicing device of the invention, with the splicing head thereof partially broken away and in section.
Figure 2:
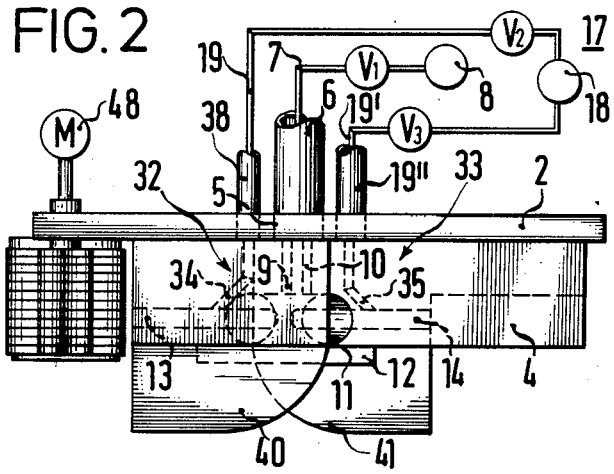
FIG. 2 is a fragmentary top plan and schematic view of the thread-splicing device according to FIG. 1.

Referring now to the figures of the drawings in detail and first particularly to the first embodiment of FIGS. 1 and 2 thereof, in which only those parts which are essential to the invention have been shown, there is seen a compressed air thread splicing device designated with reference numeral 1, having a base plate 2 on which a splicing head 4 is fastened by means of a holding screw 3. The base plate 2 has a bore 5 formed therein which is fitted with a short tube 6, to which a line 7 is attached. The line 7 leads through a control valve V1 to a compressed air source 8. Two compressed air inlet openings 9 and 10 lead into a splicing channel 11 from the tube 6. The channel 11 can be closed by a cover 12 after the threads are inserted, and is kept closed until the thread splicing operation is completed.

The splicing head 4, which is partially broken away in FIG. 1, is provided with two flow channels 13 and 14, which branch off from the splicing channel 11 transversely to the direction of motion of the inserted threads 30, 31. The flow channel 13 discharges into the splicing channel 11 at a slant toward the direction of the closer, upper end 15 of the splicing channel 11, into the region between the compressed air orifices or inlets 9, 10 and the upper end 15 of the splicing channel 11. Correspondingly, the flow channel 14 discharges into the splicing channel 11 at a slant toward the direction of the closer end 16 of the splicing channel 22. Both flow channels 13, 14 discharge into the open transversely to the direction of motion of the threads 30, 31 which are inserted in the splicing channel 11.

The flow channels 13, 14 are connected to a flow generating device, which is designated as a whole with reference numeral 17. The flow generating device 17 is formed of a compressed air source 18, with a control valve V2 and an injector device 32 for the flow channel 13, and a control valve V3 and an injector device 33 for the flow-channel 14.

An injection air line 19 leads from the valve V2 to a pipe 38 which is fitted into the base plate 2, and the line 19 is connected to an injector air channel 34. The injector air channel 34 discharges into the flow channel 13 at a slant facing away from the splicing channel 11. An additional injection air line 19' leads from the valve V3 to an injector channel 35 through a pipe 19'', which is also fitted into the base plate 2. The injector air channel 35 discharges into the flow channel 14 at a slant facing away from the splicing channel 11.

FIG. 1 shows that a contour 40 for guiding the thread is provided at the upper end 15 of the splicing channel 11, and a contour 41 for guiding the thread is provided at the lower end 16 of the channel.

FIG. 2 shows that the respective thread guide contours 40, 41 cover approximately half of the respective ends of the splicing channel 11. The contours for guiding the thread are formed by special parts which are fastened to the splicing head 4. The cover 12 is wide enough so that it covers the whole length of the splicing channel 11 in the closed position. In contrast to the splicing channel 11, the flow channels are not open in their longitudinal direction but are formed by bores within the splicing head 4.

The base plate 2 carries a metallic thread guide 20 at the top thereof and a corresponding guide 21 at the bottom. Above the thread guide 20 is a device 22 for cutting or severing the thread 30 and below the thread guide 2 is a device 23 for severing the thread 31. Alongside the thread cutting device 22 are thread loop pulling means 24 which can swing around an axis 26. Adjacent the other thread cutting device 23 are similar thread loop pulling means 25 which pivot around an axis 27. An additional metal thread guide 28 is disposed above the thread cutting device 22, and a corresponding thread guide 29 is disposed under the thread cutting device 23.

FIG. 1 shows the position of the threads 30 and 31 which are to be joined after they are inserted into the splicing channel 11. The thread 30 comes from the bottom right, changes its direction at the thread guide contour 41, runs through the splicing channel 11 and the diagrammatically illustrated cutting device 22, and lies at the thread guide 28. The other thread 31 comes from the top left, changes its direction at the thread guide contour 40, runs through the splicing channel 11 parallel to thread 30, passes the diagrammatically illustrated cutting device 23, and lies at the thread guide 29.

The two thread cutting devices 22 and 23 are only operated after the cover 12 has closed. A thread end is therefore created at each thread, while the cut-off part or length of the thread is removed by non-illustrated means. It is essential to bring each thread end to the nearest flow channel 13, 14, respectively, for the preparation of the newly created thread ends 30′, 31′. There are various ways to do this.

One possibility for bringing the thread end 30′ into the flow channel 13 after cutting the thread 30, is to not cut the thread initially and to open the valve V2 for supplying air, in conjunction with the operation of the thread cutting device 22. Due to the injector action, an air stream flowing in the direction of the arrow 42 is generated in the flow channel 13, which pulls along the thread end 30′ with it, as shown in FIG. 1. After this has happened, the other thread cutting device 23 is operated and the valve V3 is opened. The thread end 31′ which was created by cutting the thread 31 is thus caught and pulled along through the flow channel 14 in the direction of the arrow 43 by the air flow. The sequential operation ensures that only one thread or thread end is gripped by the air flow with which it is associated.

Another possibility for bringing the thread ends into the flow channels is to operate the two thread cutting devices simultaneously. In this case, both air flows which are directed in opposite directions attempt to pull along both threads. However, the respective thread end is finally sucked into the nearest flow channel, held there, and split up into its individual fibers by pneumatic action. FIG. 1 indicates that mechanical means may also be used additionally to prepare the thread ending. According to FIG. 1 and FIG. 2, a thread preparation device 44 is disposed in front of the outlet 37 of the flow channel 13. This thread end preparation device 44 is formed of a fan-like wheel 46 with blades which can rotate with respect to a thread guide surface 45.

The four blades of this wheel 46 are constructed to function like brushes, and during the rotation of the wheel 46, the blades slide in the direction of the curved arrow 47 on the convex thread guide surface 45, which is arched toward the wheel 46. The wheel 46 is driven by a small motor 48.

If the above-described wheel 46 is provided, the thread end 30′ emerging from the flow channel 13 is gripped by the blades, so that a new thread ending is prepared between the thread guide surface 45 and the blades of the wheel 46. The fibers of the new thread ending are especially well separated and prepared. The excessive thread ending or excessive fibers can be gripped by a movable clamp 49, and removed.

FIGS. 1 and 2 show both devices for preparing the thread ends. The thread ending 31′ is only pneumatically prepared, while the thread ending 30′ is additionally mechanically prepared as well.

After the thread ends are prepared for splicing, the actual splicing operation is initiated by retracting the thread ends at least partially from the flow channels 13 and 14. This is done by the thread loop pullers 24 and 25. By swinging the two thread loop pullers 24 and 25 downward, thread loops are formed, and the threads are correspondingly retracted. FIG. 1 shows the two thread loop pullers in the swung position. During the insertion of the thread, the thread loop pullers 24 and 25 are oriented vertically, as indicated by small circles in FIG. 1.

After the cover has closed and the thread ends are retracted, the actual splicing operation can begin. For this purpose, the valve V1 is opened for short time intervals, thereby producing pressure surges through both compressed air orifices 9 and 10 into the splicing channel 11. The inflowing compressed air escapes at the ends 15 and 16 of the splicing channel 11 into the open, and thereby pulls along the air in the flow channels 13 and 14. The two other valves V2 and V3 are closed when the valve V1 is opened, or in some cases they remain open, in order to continue to hold the thread ends for a certain time in the flow channels.

After the splice connection has been made and after the valves are closed, the cover 12 is opened and the two thread loop pullers 24 and 25 are moved back to the vertical position. The thread can then jump out of the splicing channel 11 due to the pull of the thread which then exists.

Figure 3:
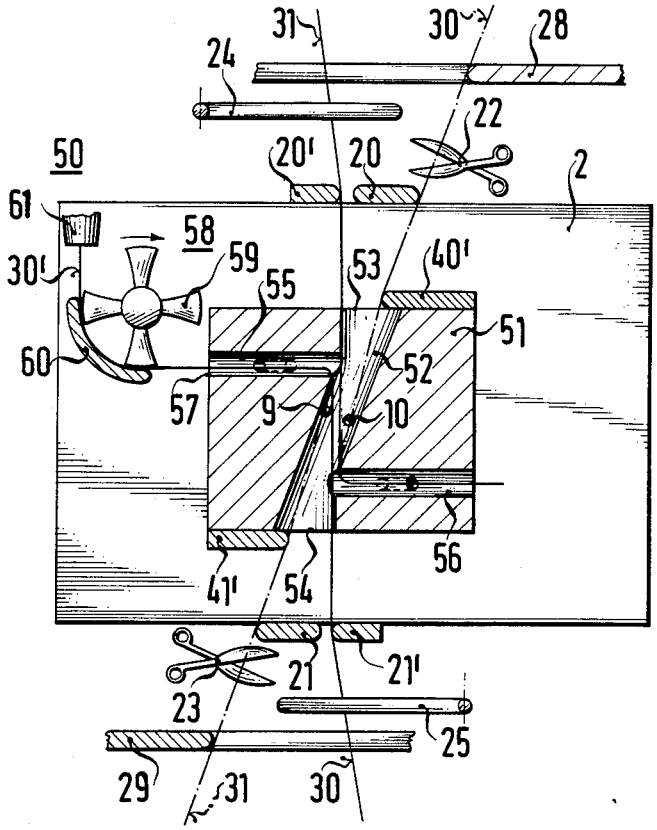
FIG. 3 is a view similar to FIG. 1 of another embodiment of the compressed air thread splicing device.

The embodiment shown in FIG. 3 corresponds in principle to the embodiment shown in FIG. 1. Most of the details of the compressed air splicing device 50 shown in FIG. 3 also correspond with the details of the compressed air splicing device according to FIG. 1, and they carry the same reference numerals.

The second embodiment of the invention according to FIG. 3 contains the following differences as compared to the embodiment according to FIG. 1 and FIG. 2:

A second thread guide 20′ is provided adjacent the metallic thread guide 20, and another thread guide 21′ is adjacent the thread guide 21. The splicing head 51 has a splicing channel 52, which is expanded at its ends 53, 54. The thread guide contours 40′, 41′ have a somewhat different position than in the first embodiment, and do not cover the ends of the splicing channel quite as much. The flow channels 55, 56 in FIG. 3 also discharge into the open air. In front of the outlet 57 of the flow channel 55, a thread end preparation unit 58 is provided. The unit 58 is formed of a bladed wheel 59 disposed opposite a concave thread guide surface 60. The four blades of the wheel 59 do not touch the concave surface, but are kept at a small distance from the surface so that there is no friction causing contact. This bladed wheel 59 has no driver of its own. It is driven by the air escaping from the flow channel 55. A suction pipe 61 is disposed downstream of the wheel 59, and accepts waste fibers and fiber particles. In the FIG. 3 embodiment, inserted threads 30, 31 do not lie as close to each other in the splicing channel 52 as in the splicing channel of the first embodiment.

Figure 4:
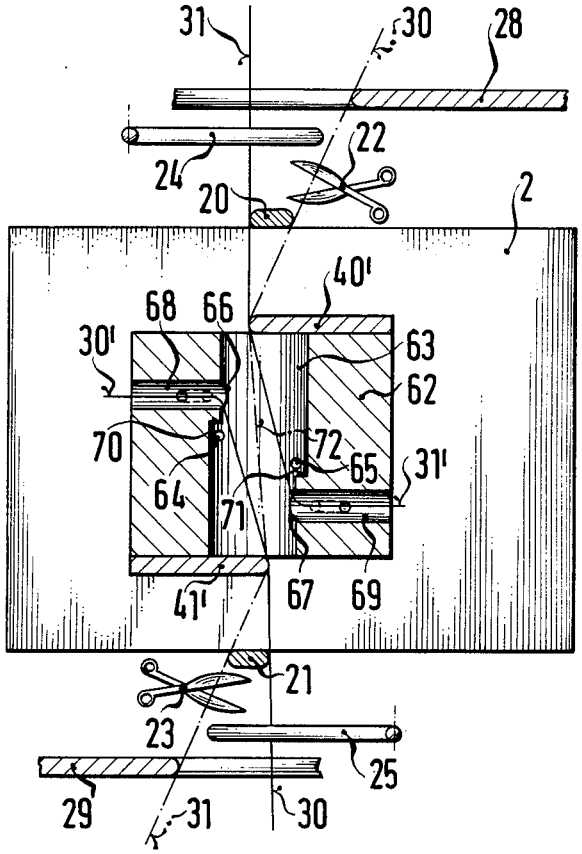
FIGS. 4, 5 and 6 are views similar to FIG. 1 of additional embodiments of compressed air thread splicing devices.

The third embodiment of the invention according to FIG. 4 is similar to the second embodiment according to FIG. 3, so that various parts again have the same reference numerals. However, the splicing head 62 has a much wider splicing channel 63 which is not slanted, and is provided with flow obstructions 70, 71, in the region between the compressed air orifices 64, 65 and the ends 66, 67 of the flow channels 68, 69. The line 72 indicates that the two threads 30, 31 lie closely adjacent to each other after insertion. Only during the preparation of the thread ends 30', 31', respectively, is the closeness of the two threads abandoned for a short time.

Figure 5:
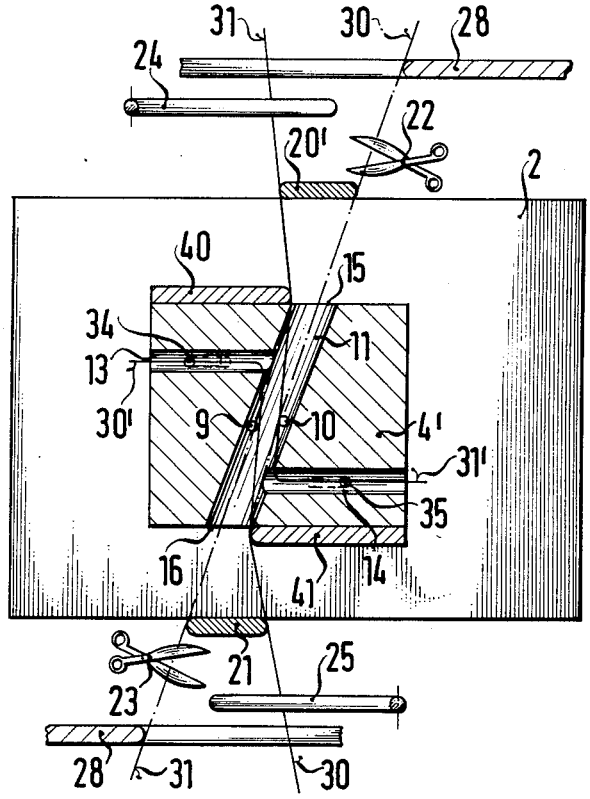

The fourth embodiment according to FIG. 5 differs from the first embodiment according to FIG. 1, essentially by the fact that the thread guide contours 40, 41 in FIG. 5 do not cover the ends 15, 16 of the splicing channel 11. The splicing head 4' also has two flow channels 13 and 14 leading to the outside. These flow channels are also provided with injector devices. Furthermore, the threads inserted into the splicing channel 11 are not as closely adjacent as in the first embodiment.

Figure 6:
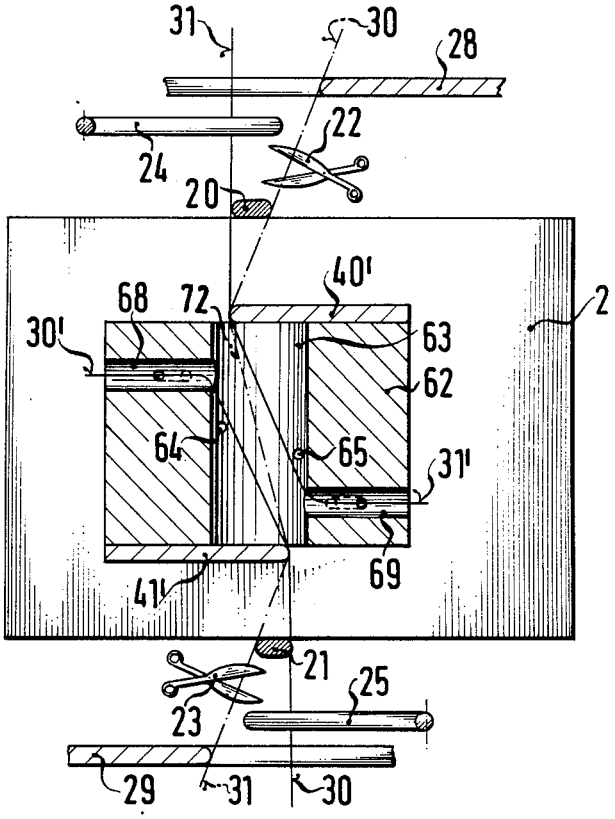

The fifth and last embodiment according to FIG. 6 is most similar to the third embodiment according to FIG. 4. The difference between the third and fifth embodiments is that in the fifth embodiment no obstructions to the flow are provided in the splicing channel 63.

In all of the illustrated embodiments, the flow cross section of a flow channel is much smaller than the flow cross section of the splicing channel, although it should be noted that in some embodiments the ends of the splicing channel are partially covered, and that again a different flow cross section is present there than in the splicing channel itself. The devices providing the air flow for supplying the flow channels in all of the other embodiments are similar to the flow or current generating device 17 of the first embodiment The invention is not limited to the illustrated and described embodiments which were used as examples.

We claim:

1. Compressed air thread splicing device for producing a knot-free thread connection by splicing, comprising a splicing head having a splicing channel formed therein with two at least partially open ends for receiving threads to be joined in a given insertion direction and for alternately tangling, intertwining, swirling and winding fibers of the threads around each other, said splicing head having at least one compressed air inlet orifice formed therein leading into said splicing channel, said splicing head having at least one flow-channel formed therein branching off from said splicing channel transverse to said given insertion direction between said at least one inlet orifice and one of said ends of said splicing channel, and switchable means connected to said at least one flow channel for generating a temporally limited current in said at least one flow channel in a flow direction away from said splicing channel, said current generating means including an injector leading into said at least one flow channel.

2. Compressed air thread splicing device according to claim 1, wherein said at least one flow channel has a smaller flow cross section than said splicing channel.

3. Compressed air thread splicing device according to claim 1, wherein said injector includes an air injector channel discharging into said at least one air flow channel in said splicing head and slanting in said flow direction away from said splicing channel.

4. Compressed air thread splicing device according claim 1, wherein said at least one flow channel discharges into the surroundings.

5. Compressed air thread splicing device for producing a knot-free thread connection by splicing, comprising a splicing head having a splicing channel formed therein with two at least partially open ends for receiving threads to be joined in a given insertion direction and for alternately tangling, intertwining, swirling and winding fibers of the threads around each other, said splicing head having at least one compressed air inlet orifice formed therein leading into said splicing channel, said splicing head having at least one flow-channel formed therein branching off from said splicing channel transverse to said given insertion direction between said at least one inlet orifice and one of said ends of said splicing channel, and switchable means connected to said at least one flow channel for generating a temporally limited current in said at least one flow channel in a flow direction away from said splicing channel, said at least one flow channel ending at said splicing channel closer to one of said ends of said splicing channel than the other, and said flow channel being slanted toward said one end of said splicing channel.

6. Compressed air thread splicing device for producing a knot-free thread connection by slicing, comprising a splicing head having a splicing channel formed therein with two at least partially open ends for receiving threads to be joined in a given insertion direction and for alternately tangling, intertwining, swirling and winding fibers of the threads around each other, said splicing head having at least one compressed air inlet orifice formed therein leading into said splicing channel, said splicing head having at least one flow-channel formed therein branching off from said splicing channel transverse to said given insertion direction between said at least one inlet orifice and one of said ends of said splicing channel, and switchable means connected to said at least one flow channel for generating a temporally limited current in said at least one flow channel in a flow direction away from said splicing channel, said at least one flow channel having an end leading into said splicing channel, and said splicing head having a flow obstruction in said splicing channel between said at least one inlet orifice and said end of said flow channel.

7. Compressed air thread splicing device for producing a knot-free thread connection by splicing, comprising a splicing head having a splicing channel formed therein with two at least partially open ends for receiving threads to be joined in a given direction and for alternately tangling, intertwining, swirling and winding fibers of the threads around each other, said splicing head having at least one compressed air inlet orifice formed therein leading into said splicing channel, said splicing head having at least one flow-channel formed therein branching off from said splicing channel transverse to said given insertion direction between said at least one inlet orifice and one of said ends of said splicing channel, switchable means connected to said at least one flow channel for generating a temporally limited current in said at least one flow channel in a flow direction away from said splicing channel, said at least one flow channel having a discharge end, and including a thread end preparation device disposed upstream of said discharge end, said preparation device including at least one contact surface movable toward a thread end projecting from said discharge end for contacting fibers of the thread, said contact surface being acted upon by escaping compressed air from said discharge end.

8. Compressed air thread splicing device according to claim 7, wherein said thread end preparation device is in the form of a wheel having blades rotating adjacent a thread guiding surface.

9. Compressed air thread splicing device according to claim 8, wherein said thread guiding surface is curved.

* * * * *